United States Patent [19]

Griswold et al.

[11] Patent Number: 4,543,894

[45] Date of Patent: Oct. 1, 1985

[54] PROCESS FOR STAGED COMBUSTION OF RETORTED OIL SHALE

[75] Inventors: Charles F. Griswold, Brea; Ben A. Christolini, Jr., Anaheim, both of Calif.

[73] Assignee: Union Oil Company of California, Los Angeles, Calif.

[21] Appl. No.: 495,505

[22] Filed: May 17, 1983

[51] Int. Cl.[4] ..... F23D 1/00

[52] U.S. Cl. ..... 110/347; 110/215; 110/245; 110/263; 110/345; 122/4 D; 201/31; 208/8 R; 208/11 R; 208/127

[58] Field of Search ..... 431/170, 352; 110/235, 110/245, 261, 263, 265, 347, 345; 201/31, 32; 208/8 R, 11 R, 127; 122/4 D; 60/620

[56] References Cited

U.S. PATENT DOCUMENTS

| | | | |
|---|---|---|---|
| 2,734,851 | 2/1954 | Smith | 202/14 |
| 3,414,504 | 12/1968 | Oldweiler | 208/127 |
| 3,501,394 | 3/1970 | Lyons | 208/11 R |
| 3,563,911 | 2/1971 | Pfeiffer et al. | 252/417 |
| 3,924,576 | 12/1975 | Siewert | 60/620 |
| 4,010,092 | 3/1977 | Deering | 208/11 R |
| 4,069,132 | 1/1978 | Deering | 208/11 R |
| 4,083,770 | 4/1978 | Deering | 208/11 R |
| 4,101,412 | 7/1978 | Chei | 208/8 R |
| 4,173,118 | 11/1979 | Kawaguchi | 431/352 |
| 4,181,705 | 1/1980 | Gumerman | 110/245 |
| 4,199,432 | 4/1980 | Tamm et al. | 201/31 |
| 4,243,489 | 1/1981 | Green | 208/11 R |
| 4,293,401 | 10/1981 | Sieg | 201/31 |
| 4,298,453 | 11/1981 | Schoennagel et al. | 208/8 R |
| 4,308,810 | 1/1982 | Taylor | 122/4 D |
| 4,312,740 | 1/1982 | Chiaramonte | 208/11 R |
| 4,336,126 | 6/1982 | Bertelsen | 208/11 R |
| 4,336,127 | 6/1982 | Bertelsen | 208/11 R |
| 4,373,454 | 2/1983 | Pitrolo et al. | 201/31 |
| 4,413,573 | 11/1983 | Hall et al. | 110/263 |

OTHER PUBLICATIONS

"Calcined Lime and in Situ Formed Char as Catalysts for 'NO' Reducing Gases," by Takehiko Furusawa, et al., Proceedings of the International Conference on Fluid Bed Combustion, 7th, vol. 1, 1982, pp. 525–533.

*Primary Examiner*—Edward G. Favors
*Assistant Examiner*—Steven E. Warner
*Attorney, Agent, or Firm*—June M. Bostich; Gregory F. Wirzbicki; Dean Sandford

[57] ABSTRACT

A two-stage process for staged combustion of crushed retorted particles, especially sulfur and nitrogen-bearing shale, provides maximum heat from combustible materials in shale while emissions of carbon monoxide and oxides of sulfur and nitrogen are minimized. In the first stage, combustion is maintained under fluidizing conditions with a substoichiometric amount of oxygen. Off-gases from the first stage are burned in a second-stage combustion zone utilizing an oxygen-containing gas stream controlled to limit emission of carbon monoxide in the flue gas. To minimize production of sulfur oxides, combustion temperature is concurrently maintained below a peak value of 1700° F. by introducing inert gas or recycled decarbonized fines to the first-stage combustion zone to reduce temperature therein.

34 Claims, 1 Drawing Figure

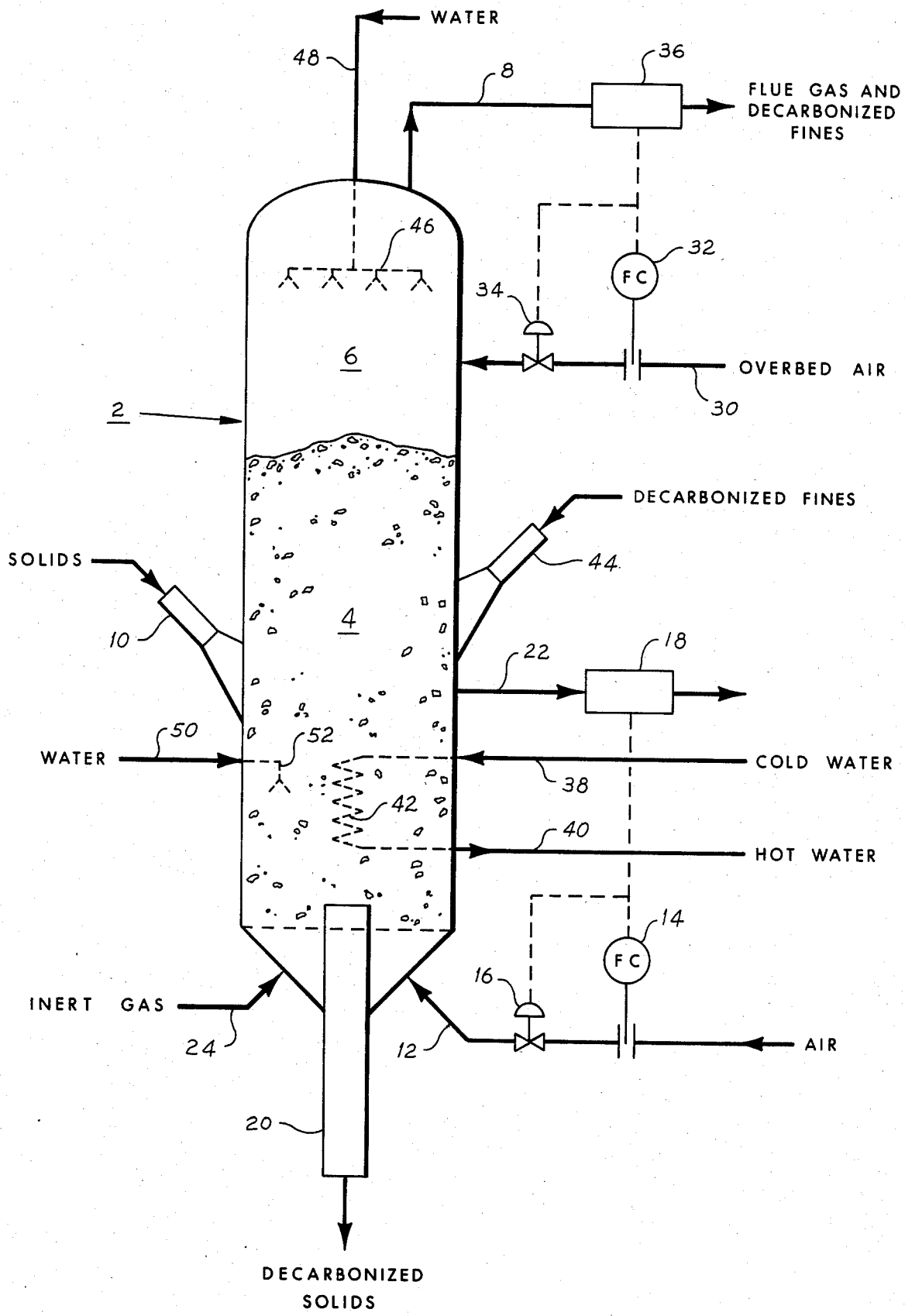
WATER
48
8
36
FLUE GAS AND DECARBONIZED FINES
46
32
FC
34
6
OVERBED AIR
30
2
DECARBONIZED FINES
SOLIDS
44
4
10
22
18
50
52
WATER
COLD WATER
38
42
40
HOT WATER
14
FC
16
INERT GAS
24
12
AIR
20
DECARBONIZED SOLIDS

PROCESS FOR STAGED COMBUSTION OF RETORTED OIL SHALE

BACKGROUND OF THE INVENTION

This invention relates to retorting processes for recovering product hydrocarbons from oil shale and other hydrocarbon-bearing solids. The invention most particularly relates to those oil shale retorting processes wherein coke on the retorted shale is combusted to provide heat energy.

Many methods for recovering oil from oil shale have been proposed, nearly all of which utilize some method of pyrolytic eduction commonly known as retorting. To be competitive with the production of oils from petroleum stocks, the principal difficulty to be overcome has been recovering essentially all heat value from carbonaceous material in the shale without incurring prohibitive expense or environmental damage. Since shale usually contains only about 20 to 80 gallons of oil per ton, only a limited proportion of which can be recovered as product oil or gas, economical retorting must utilize remaining heat energy contained in the shale to provide heat for pyrolitic eduction. However, sulfur emissions in flue gases released from the retorting process must be restricted to the low levels required by law while this goal is being attained.

It is known to retort oil shale by a technique of contacting up-flowing oilbearing solids with down-flowing gases in a vertical retort, and one such technique is disclosed in U.S. Pat. No. 3,361,644. To educe product vapors, the upward-moving bed of shale particles exchanges heat with a down-flowing, hydrocarbonaceous and oxygen-free eduction gas of high specific heat introduced into the top of the retort at about 950° to 1200° F. In the upper portion of the retort, the hot eduction gas educes hydrogen and hydrocarbonaceous vapors from the shale and, in the lower portion, preheats the ascending bed of particles to retorting temperatures. As preheating continues, the eduction gas steadily drops in temperature, condensing high boiling hydrocarbonaceous vapors into a raw shale oil product while leaving a product gas of relatively high BTU content. The shale oil and product gas are then separated, and a portion of the product gas, after being heated, is recycled to the top of the retort as the eduction gas.

Retorted shale contains heat value in the form of coke, and many retorting processes pass retorted shale particulates through a combustion zone to combust the coke and thus recover heat energy. Because flue gases from combustion zones associated with shale retorts are usually at high temperature, many retorting processes recover heat therefrom. For example, as taught in U.S. Pat. No. 4,069,132, the hot flue gases may be utilized to exchange heat indirectly with boiler feedwater to generate process steam.

Maximizing the amount of heat energy recovered from oil shale by combusting coke on the retorted shale requires complete combustion. However, the difficulty of fully combusting coke deeply embedded in the relatively large-sized particles obtained from a retort similar to that disclosed in U.S. Pat. No. 4,069,132 has hampered the development of such a process. One can, of course, crush the shale in order to expose more coke for combustion, but retorting finely crushed shale generates unacceptable large pressure drops in the retort. On the other hand, crushing the shale subsequent to retorting poses twin problems of efficiently transporting and combusting small-sized particulate matter, which tends on the one hand to pack and plug during transport and on the other hand to require combustion as a fluidized bed.

Combustion of retorted shale to recover heat energy poses the additional difficulty of controlling the emission of pollutants from the combustor. Because retorted shale generally contains nitrogen and sulfur components, less than complete combustion of the coke generates carbon monoxide, ammonia, and hydrogen sulfide gases, the latter of which must be removed from flue gases by means of costly sulfur recovery processes. On the other hand, complete combustion may result in flue gases containing unacceptable amounts of nitrogen and sulfur oxide gases.

To solve the problem of sulfur dioxide production during complete combustion, U.S. Pat. No. 4,069,132 discloses a combustion process wherein the sulfur dioxide generated during the combustion of coke on the retorted shale is converted to stable inorganic salts by reaction with alkaline ingredients of the shale. This process utilizes a combustor through which hot retorted shale gravitates co-currently with air for combustion diluted by sufficient flue gas to control peak combustion temperature below 1670° F. Under such conditions, the discharge of sulfur dioxide from the combustor is disclosed to be greatly minimized.

While the foregoing have met with some success, the need exists for further developments in shale retorting technology. In particular, a need exists for an oil shale retorting process for combusting crushed particles of retorted shale in a staged bed fluidized combustor for maximizing the amount of coke combusted while simultaneously minimizing the amounts of carbon monoxide and oxides of nitrogen and sulfur discharged to the atmosphere during said combustion.

Accordingly, a principal object of this invention is to provide an oil shale retorting process employing a two-stage combustor comprising a primary fluidized bed stage of combustion for maximizing recovery of heat energy from the retorted shale and a secondary overbed stage of combustion for minimizing the noxious gases emitted from the combustor.

Another object of the invention is to provide an oil shale retorting process employing recirculation of decarbonized fines to the combustor to aid in regulating temperature in the combustor and thereby minimize the amount of sulfur and nitrogen oxides discharged to the atmosphere during said combustion.

It is yet another object to provide an oil shale retorting process employing an ammonia sensitive control system for regulating the amount of oxygen fed into the dense bed combustion zone of said staged bed fluidized combustor.

These and other objects of the invention will be apparent from the following description taken in conjunction with the drawing.

SUMMARY OF THE INVENTION

The present invention provides a process for two-staged combustion of crushed retorted particles containing combustible materials comprising sulfur and nitrogen-containing compounds, especially retorted shale particles, under conditions in which a substantial proportion of the combustible material is combusted while producing a flue gas of relatively low carbon monoxide, nitrogen oxides, and sulfur oxides content. In a first-stage combustion zone, the crushed particles are burned as a fluidized bed in the presence of a fluidizing gas stream containing a substoichiometric quantity of oxygen. The crushed particles are discharged from said first-stage combustion zone in a relatively decarbonized condition. Off-gases from the first-stage combustion zone are burned in a second-stage combustion zone fed by a gas stream comprising oxygen sufficient to produce a flue gas of relatively low carbon monoxide, sulfur oxides, and nitrogen oxides content.

In the preferred embodiment, the content of gaseous ammonia in the first-stage combustion zone is maintained at or below 50 ppm by volume by adjusting the rate at which the fluidizing gas stream containing oxygen is directed therein.

BRIEF DESCRIPTON OF THE DRAWING

In the drawing is shown a flowsheet of the process of the invention, including the preferred embodiment thereof.

DETAILED DESCRIPTION OF THE INVENTION

The preferred embodiment of the invention shown in the drawing comprises staged bed fluidized combustor 2 for combusting crushed retorted shale particles to recover the maximum heat energy therefrom while minimizing the production of noxious gases. The first-stage combustion zone, a fluidized combustion zone, is maintained in the dense bed at 4 for the purpose of maximizing decarbonization of the retorted shale. In freeboard area 6 of combustor 2, a second-stage combustion zone is maintained in which gases and partially combusted shale fines disengaging from the fluidized combustion zone undergo additional oxidation, preferably to maximize the combustion of combustible gases and fines containing combustible matter before their discharge from combustor 2 via conduit 8. As the result of staged combustion in the first and second stage combustion zones of combustor 2, maximum heat energy is generated from the combustible gases and solids introduced therein, which heat energy is available for recovery (by means not shown) from the flue gas and solids removed from combustor 2 at conduits 8 and 20, respectively. At the same time, the gaseous pollutants in the flue gas in conduit 8, especially carbon monoxide and oxides of sulfur and nitrogen are curtailed to environmentally acceptable levels.

Typically, the overall combustion achieved in combustor 2 is at least sufficient to leave no more than 20 percent of the coke that was present on the shale entering via conduit 10. Preferably, no more than 10 percent remains, and in the most preferred embodiment, no more than 5 percent remains. The concentrations of noxious components in the flue gases exiting from combustor 2 via conduit 8 are simultaneously limited, typically to less than 50 ppm of sulfur oxides, less than 500 ppm of nitrogen oxides and less than 500 ppm of carbon monoxide by volume, and preferably to less than 5 ppm of sulfur oxides, less than 50 ppm of nitrogen oxides, and less than 50 ppm of carbon monoxide by volume. Using retorted shale from the Green River formation, the mass ratios of noxious components emitted per ton of retorted shale fed to combustor 2 are correspondingly limited, typically to less than 0.1 pound of sulfur oxides, less than 1.0 pound of carbon monoxide, and less than 1.0 pound of nitrogen oxides, and preferably to less than 0.01 pound of sulfur oxides, less than 0.1 pound of nitrogen oxides, and less than 0.1 pound of carbon monoxide per ton of retorted shale fed to combustor 2.

To achieve these objectives, crushed shale particles at a relatively high temperature, usually above about 500° F. and preferably above about 800° F., and after being crushed to a size usually no greater than $\frac{1}{2}$ inch, and preferably to less than $\frac{1}{4}$ inch mean diameter, are transported into combustor 2 via conduit 10 from a source not shown, typically from a crusher associated with an oil shale retort. Usually the crushed particles are accompanied by a gas stream, for example an entraining gas stream, comprising relatively small amounts of fuel gases, such as carbon monoxide and hydrogen; hydrocarbonaceous gases, such as methane and ethane; and/or sulfur and nitrogen-containing gases, such as sulfur and nitrogen oxides, hydrogen sulfide and ammonia.

From conduit 10, the crushed particles and any accompanying gases are delivered into dense bed 4 of combustor 2 wherein a fluidized combustion zone is maintained by the fluidizing action of an oxygen-containing gas stream, preferably comprising air, directed therein via conduit 12. Operating under fluidized combustion conditions allows for high combustion efficiency of the finely crushed particles, which expose more coke than larger-sized particles to the gaseous oxygen required to support combustion. Fluidized combustion of the retorted shale particles, since it maximizes contact between gases and the particulate solids, also aids in the formation of solid sulfur-containing compounds by the reaction of gaseous sulfur dioxide with retorted shale.

Fluidized combustion is typically achieved in dense bed 4 of combustor 2 by introducing therein a fluidizing gas stream via conduit 12 at a rate and velocity required to maintain the desired degree of combustion while maintaining the crushed particles as a fluidized bed. In the preferred embodiment, during normal operations, the fluidizing gas stream comprising air is preheated by indirect heat exchange with hot flue gases removed from combustor 2 via conduit 8 (in a heater not shown) to a temperature between about 100° and about 800° F. and introduced into the region of dense bed 4 via conduit 12 at a linear velocity between about 2 and 15 feet per second, preferably between 3 and 6 feet per second, and at a rate of about 6,000 to 20,000 SCF per ton, typically about 10,500 to about 11,900 SCF per ton of shale particles carried in conduit 10, said air flow being typically between about 60 and about 100 percent, and preferably between about 75 and about 85 percent of that necessary for complete combustion of the combustible materials in the retorted shale. The rate of flow of the fluidizing gas stream comprising air in conduit 12 is controlled by the operation of flow controller 14 upon flow control valve 16 in response to a measurement by gas sensor 18 of the concentration of gaseous ammonia in a slip stream removed via conduit 22 from dense bed 4 of combustor 2.

The first step in limiting the concentration of gaseous pollutants in the flue gas leaving combustor 2 in conduit 8 is adjusting the flow of air to the first-stage combustion zone so as to limit the concentration of ammonia in the gases contained in conduit 22. The desired concentration of gaseous ammonia in conduit 22 is typically between about 5 and about 100 ppm by volume, and preferably between about 5 and about 50 ppm by volume. When the concentration of ammonia in conduit 22 differs substantially from that above specified, the flow of air in the fluidizing gas stream is preferably adjusted by flow controller 14, an increase in air flow being used to decrease the concentration of ammonia in conduit 22 and thereby ultimately to decrease the mass rate at which nitrogen oxides are emitted from combustor 2.

The second step in limiting production of noxious gases, especially nitrogen oxides and carbon monoxide, in combustion flue gases in conduit 8 requires concurrent regulation of the overbed air stream into the second-stage combustion zone. In the preferred embodiment, combustion in the second-stage combustion zone of the off-gases from the first-stage combustion zone results in minimum emissions of gaseous pollutants as described above. Hydrogen sulfide and ammonia, which are produced at low levels in this invention by combustion as heretofore described in the first-stage combustion zone, are essentially completely combusted in the second-stage combustion zone, resulting in emission at correspondingly low mass ratios of pounds of oxides of sulfur and nitrogen per ton of retorted shale combusted as described above. Combustion in the second-stage combustion zone of carbon monoxide in the off-gases from the first-stage combustion zone converts sufficient carbon monoxide to carbon dioxide such that the concentration and mass ratio of carbon monoxide emitted per ton of shale combusted are limited as described above.

The second-stage combustion in combustor 2 is maintained in freeboard area 6 by introducing therein an overbed gas stream via conduit 30. Typically, the overbed gas stream comprises between about 10 and about 50 percent, and preferably between about 25 and about 35 percent, of the total air required for complete combustion of the combustible materials in the retorted shale particles and accompanying gases fed into dense bed 4 via conduit 10. The rate of flow of the overbed gas stream, typically between about 1,000 and about 10,000 SCF, and preferably between about 3,500 and about 4,900 SCF per ton of retorted shale particles fed into dense bed 4 via conduit 10, is controlled by the operation of flow controller 32 upon flow control valve 34 in response to gas sensor 36 situated on conduit 8 for the purpose of monitoring the concentration of carbon monoxide gas therein. Typically, the flow rate of the overbed gas stream is adjusted by flow controller 32 so as to maintain the concentration of gaseous carbon monoxide in conduit 8 at a level less than about 500 ppm by volume, and preferably to less than 50 ppm by volume.

Regulating the rates of air flow into the fluidizing and overbed gas streams in accordance with this invention results in the preferred limitation of gaseous sulfur and nitrogen oxides in the flue gas stream in conduit 8 only so long as temperature in combustor 2 is maintained below a maximum of about 1700° F. Combustor 2 may be operated at any elevated temperature sufficient to promote combustion of coke on the crushed shale particles, but preferred operation is such that the peak temperature lies between about 1400° and about 1670° F., as for example, 1550° F. Higher temperatures are generally avoided because operation at temperatures in excess of about 1700° F. results in high level emissions of sulfur and nitrogen oxides in the combustion flue gases. On the other hand, combustion temperatures below about 1700° F., and particularly below about 1670° F., result in substantially reduced levels of sulfur and nitrogen oxides. At these temperatures gaseous sulfur components in dense bed 4 will react essentially to completion with alkaline components in the crushed shale particles and remain therewith as stable sulfur-containing solids, and nitrogen from the air will not burn to form oxides.

Temperature in combustor 2 can be controlled by several means taken alone or in conjunction with one another as desired. Temperature can be reduced by indirect heat exchange with water in bed coils 42 into which cool water is directed via conduit 38 and from which heated liquid water or steam is removed via conduit 40. Reduction in temperature can also be achieved by introducing water into first-stage combustion zone 4, as, for example, via sprayer 52 attached to conduit 50 or into second-stage combustion zone 6, as, for example, via sprayer 46 attached to conduit 48. Alternatively, to decrease the temperature in combustor 2, decarbonized fines and/or inert gas such as flue gases, for example those recovered from conduit 8, can be introduced into the first-stage combustion zone. In the preferred embodiment, decarbonized fines and flue gases removed via conduit 8 are segregated in a cyclone separator (not shown) or other means of separating gases from particulate solids, a portion of the decarbonized fines being returned to dense bed 4 via conduit 44 and a portion of the flue gases being admixed via conduit 24 into the fluidized bed maintained within the first-stage combustion zone to aid in decreasing the temperature in combustor 2. The proportion of decarbonized fines fed into the first-stage combustion zone is typically limited to less than about 50 percent by weight of all particles fed into said first-stage combustion zone and the temperature of said decarbonized fines is generally between about ambient and about 1200° F., preferably between about 400° and about 800° F. The admixture of flue gases into the fluidized bed should not, of course, be allowed to interfere with the flow requirements for fluidization and combustion as set forth hereinabove.

During periods of reduced shale feed to the combustor, such as during start-up and shut-down, the flow requirements necessary for optimal fluidizing conditions remain unchanged, but the flow requirement for oxygen to supply the desired percentage of complete combustion is correspondingly decreased. At such times, the flow of gas necessary for fluidization in excess of the flow of oxygen-containing gas needed to achieve the desired percentage of complete combustion in the dense bed (as set forth hereinabove) can be maintained by introducing into conduit 12 via conduit 24 an inert diluent gas (from a source not shown), such as recycled flue gas or steam. Preferably, recycled flue gas, such as that removed from combustor 2 via conduit 8, is admixed into the fluidized bed maintained in the first-stage combustion zone via conduit 24 as the inert diluent gas to maintain the desired conditions of fluidization and degree of combustion in dense bed 4.

Heat energy recovered from burning the carbonaceous residue on retorted oil shale is available for recovery from the combustion flue gas and decarbonized shale particles discharged from combustor 2 via conduits 8 and 20, respectively. Typically, heat energy is recovered from the combustion flue gas and from the decarbonized shale particles by means not shown using indirect heat exchange to heat water for making process steam and/or to heat process streams. For increased heat generation, raw unretorted shale fines may be added to the retorted shale particles being fed into combustor 2 via conduit 10, for example during periods of operation when the feed of retorted shale is reduced, such as during start-up of the retort.

In the preferred embodiment, the proportion of raw shale fines fed to combustor 2 is usually less than 6 percent, and preferably between about 1 and about 6 percent by weight of all shale particles fed to said first-stage combustion zone. In alternative embodiments of this invention, the percentage of raw fines fed to combustor 2 is increased, with one embodiment employing raw shale fines as the total feed to combustor 2.

The principal advantages of staged combustion of crushed retorted shale as above described are twofold. Fluidized combustion of crushed shale particles using a stoichiometric amount of oxygen at temperatures limited as described herein would recover comparable high levels of heat energy from the retorted shale while producing comparable low levels of sulfur oxides. However, nitrogen oxides emitted in combustion flue gases under these conditions are difficult to limit to environmentally acceptable levels. This invention combines first-stage fluidized combustion fed by slightly substoichiometric amounts of air, for maximizing combustion of retorted shale, with second-stage overbed combustion, for maximizing combustion of off-gases from the first stage. This two-stage combustion process offers the principal advantage of maximizing heat recovery from the retorted shale while limiting emissions of noxious gases to levels which are environmentally acceptable. Additionally, this invention offers the advantage of a process for continuously regulating the flow of air to the first-stage combustion zone so as to maintain therein the condition of a slightly substoichiometric amount of oxygen requisite to limit emission of nitrogen oxides from the combustor despite fluctuations in the chemical composition or amount of retorted particles fed to the staged combustor.

A further advantage of this invention resides in its use of fines of combusted shale ash and/or inert flue gases in the fluidization zone to aid in the control of combustion temperature, thereby providing a means for temperature control without changing the degree of combustion taking place in the first stage, on the one hand, or upsetting the established gas flow necessary for fluidization, on the other hand, as would occur if the flow of fluidizing air is adjusted to aid in controlling temperature.

Although this invention has been described in conjunction with a preferred embodiment thereof, it is evident that many alternatives, modifications, and variations will be apparent to those skilled in the art in light of the foregoing description. For example, a variety of hydrocarbon-bearing particulates may be used in the process of the invention, including coal and lignite. Accordingly, it is intended to embrace this and all such alternatives, modifications, and variations that fall within the spirit and scope of the appended claims.

We claim:

1. A process for combusting retorted shale particles of a size suitable for fluidization, said shale particles containing materials, which process comprises:

(1) combusting a substantial proportion of the combustible material contained within said shale particles by staged combustion, said staged combustion comprising:

(a) combusting said particles in a first-stage combustion zone, the particles being maintained as a fluidized bed by a fluidizing gas stream comprising oxygen introduced into said first-stage combustion zone at a rate sufficient to maintain said particles as a fluidized bed therein while providing a substoichiometric quantity of oxygen for combustion of said combustible material in said first-stage combustion zone;

(b) controlling the concentration of gaseous ammonia in said first stage combustion zone in the range between about 5 and 100 ppm by volume of the gases produced in the first stage combustion zone;

(c) combusting off-gases from said first-stage combustion zone in said second-stage combustion zone, with combustion being maintained by a gas stream comprising oxygen introduced into said second-stage combustion zone, said combustion being under conditions sufficient to produce a flue gas of relatively low carbon monoxide, nitrogen oxides, and sulfur oxides content;

(2) discharging said flue gas from said second-stage combustion zone; and (3) discharging crushed particles in a relatively decarbonized condition from said first-stage combustion zone.

2. A process for combusting shale particles as defined in claim 1 wherein said shale particles are raw shales fines.

3. A process for combusting shale particles as defined in claim 1 wherein the fluidizing gas stream fed to the first-stage combustion zone and the gas stream fed to the second-stage combustion zone comprise in total an oxygen content greater than 100 percent of that required for complete combustion of the coke present on the shale entering said first-stage combustion zone.

4. A process for combusting crushed shale particles as defined in claim 1 wherein said fluidizing gas stream comprises between about 60 and about 100 percent of the oxygen required for complete combustion of the combustible materials in the shale particles and said gas stream comprises between about 10 and about 50 percent of the oxygen required for complete combustion of the combustible materials in the shale particles.

5. A process for combusting crushed shale particles as defined in claim 4 which further comprises:

(4) maintaining the concentration of gaseous ammonia in said first-stage fluidized combustion zone between about 50 and about 100 ppm by volume by adjusting the amount of oxygen in said fluidizing gas stream; and (5) maintaining the concentration of gaseous carbon monoxide in said flue gas below about 500 ppm by volume by adjusting the amount of oxygen in said gas stream.

6. A process for combusting crushed shale particles as defined in claim 5 which further comprises:

(6) introducing into said dense bed region a mixture in any proportion of decarbonized fines of shale and inert diluent gas sufficient to control the temperature of said staged combustion at or below a peak value of 1700° F. while maintaining said particles as a fluidized bed.

7. A process for combusting crushed shale particles as defined in claim 6 wherein said decarbonized fines of shale comprise between about 1 and about 6 percent by weight of all shale particles introduced into said first-stage combustion zone.

8. A process for combusting crushed particles as defined in claim 7 which further comprises:

(7) maintaining the concentration of gaseous ammonia in the dense bed region of said first-stage combustion zone between about 50 and about 100 ppm by volume by adjusting the oxygen content of said fluidizing gas stream; and (8) maintaining the concentration of gaseous carbon monoxide in said flue gas below about 500 ppm by volume by adjusting the oxygen content of said gas stream into said second-stage combustion zone.

9. A process as defined in claim 1 wherein the content of gaseous ammonia is controlled in step (1) (b) in the range between about 50 and 100 ppm by volume of the gases produced in the first-stage combustion zone.

10. A process as defined in claim 9 wherein temperature in the first-stage combustion zone is maintained between about 1400° and 1670° F.

11. A process as defined in claim 1 wherein the retorted shale particles contain components which remove gaseous sulfur compounds during combustion in step (1) (a) in the first-stage combustion zone and in step (1) (c) in the second-stage combustion zone.

12. A process as defined in claim 1 wherein essentially decarbonized fines are introduced into the first-stage combustion zone to aid in controlling temperature therein.

13. A process as defined in claim 1 wherein flue gas diluent is introduced into the first-stage combustion zone to control temperature therein.

14. A process as defined in claim 1 wherein temperature in the first-stage combustion zone is maintained below 1700° F.

15. A process as defined in claim 14 wherein essentially decarbonized fines are introduced into the first-stage combustion zone to aid in controlling temperature therein.

16. A process as defined in claim 14 wherein flue gas diluent is introduced into said first-stage combustion zone to aid in controlling temperature therein.

17. A process for combusting crushed retorted particles containing combustible materials comprising sulfur and nitrogen-containing compounds by staged combustion, said staged combustion comprising:

(1) combusting a substantial proportion of the combustible material contained within said particles by staged combustion, said staged combustion comprising:

(a) combusting said particles in a first-stage fluidized combustion zone having a dense bed, the particles being maintained as a fluidized bed by a fluidizing gas stream comprising oxygen introduced into said first-stage combustion zone at a rate sufficient to maintain said particles as a fluidized bed while providing a substoichiometric quantity of oxygen for combustion of said combustible material in said first-stage combustion zone;

(b) combusting off-gases from said first-stage combustion zone in a second-stage combustion zone, with combustion being maintained by a gas stream comprising oxygen introduced into said second-stage combustion zone, said combustion being under conditions sufficient to produce a flue gas of relatively low carbon monoxide, nitrogen oxides, and sulfur oxides content;

(2) controlling the flow of said fluidizing gas stream so as to maintain the concentration of gaseous ammonia in said first-stage fluidized combustion zone below about 100 ppm by volume;

(3) discharging said flue gas from said second-stage combustion zone; and (4) discharging crushed particles in a relatively decarbonized condition from said first-stage combustion zone.

18. A process for combusting retorted particles as defined in claim 17 wherein said fluidizing gas stream comprises between about 60 and about 100 percent of the oxygen required for complete combustion of the combustible materials in said retorted particles and said gas stream comprises between about 10 and about 50 percent of the oxygen required for complete combustion of the combustible materials in the retorted particles.

19. A process for combusting retorted particles as defined in claim 18 which further comprises:

(5) introducing into the dense bed region of said first stage combustion zone a mixture in any proportion of decarbonized fines of said retorted particles and inert diluent gas sufficient to control the temperature of said staged combustion at or below a peak value of 1700° F. while maintaining said particles as a fluidized bed.

20. A process for combusting crushed retorted particles as defined in claim 19 wherein said decarbonized fines of shale comprises between about 1 and about 6 percent by weight of all particles introduced into said first-stage combustion zone.

21. A process as defined in claim 17 wherein the retorted shale particles contain components which remove gaseous sulfur compounds during combustion in step (1) (a) in the first-stage combustion zone and in step (1) (b) in the second-stage combustion zone.

22. A process as defined in claim 21 wherein essentially decarbonized shale fines are introduced into said first-stage combustion zone to aid in contolling temperature therein.

23. A process as defined in claim 17 wherein temperature in the first-stage combustion zone is maintained between about 1400° and 1670° F.

24. A process as defined in claim 23 wherein essentially decarbonized fines are introduced into the first-stage combustion zone to aid in controlling temperature therein.

25. A process as defined in claim 24 wherein flue gas diluent is introduced into said first-stage combustion zone to aid in controlling temperature therein.

26. A process as defined in claim 23 wherein the content of gaseous ammonia is controlled in step (1) (a) in the range between about 5 and 100 ppm by volume of the gases produced in the first stage combustion zone.

27. A process for combusting crushed retorted particles containing combustible materials comprising sulfur and nitrogen-containing compounds by staged combustion, said staged combustion comprising:

(1) combusting a substantial proportion of the combustible material contained within said particles by staged combustion, said staged combustion comprising:

(a) combusting said particles in a first-stage fluidized combustion zone, the particles being maintained as a fluidized bed by a fluidizing gas stream comprising oxygen introduced into said first-stage combustion zone at a rate sufficient to maintain said particles as a fluidized bed while providing a substoichiometric quantity of oxygen for combustion of said combustible material in said first-stage combustion zone, said fluidized bed having a dense bed region;

(b) combusting off-gases from said first-stage combustion zone in a second-stage combustion zone, with combustion being maintained by a gas stream comprising oxygen introduced into said second-stage combustion zone, said combustion being under conditions sufficient to produce a flue gas of relatively low carbon monoxide, nitrogen oxides, and sulfur oxides content;

(2) controlling the flow of said fluidizing gas stream so as to maintain the concentration of gaseous ammonia in the dense bed region of said fluidized bed below about 100 ppm by volume;

(3) discharging said flue gas from said second-stage combustion zone; and (4) discharging crushed particles in a relatively decarbonized condition from said first-stage combustion zone.

28. A process for combusting crushed retorted shale particles of a size suitable for fluidization, said shale particles containing combustible materials comprising sulfur and nitrogen-containing components and components capable of reacting with gaseous sulfur components in step 1 (a) hereinafter to produce stable solid sulfur-containing materials, which process comprises:

(1) combusting a substantial proportion of the combustible material contained within said shale particles by staged combustion, said staged combustion comprising:

(a) combusting said particles in a first-stage fluidized combustion zone, the particles being maintained as a fluidized bed by a fluidizing gas stream comprising oxygen introduced into said first-stage combustion zone at a rate sufficient to maintain said particles as a fluidized bed while providing a substoichiometric quantity of oxygen for combustion of said combustible material in said first-stage combustion zone, said first-stage combustion zone having a dense bed region;

(b) combusting off-gases from said first-stage combustion zone in a second-stage combustion zone, combustion being maintained therein by a gas stream comprising oxygen introduced into said second-stage combustion zone, said combustion being sufficient to produce a flue gas of relatively low carbon monoxide, nitrogen oxides, and sulfur oxides content;

(2) discharging said flue gas from said staged combustion;

(3) discharging crushed particles in a relatively decarbonized condition from said staged combustion;

(4) maintaining the concentration of gaseous ammonia in the dense bed region of said first-stage fluidized combustion zone between about 50 and about 100 ppm by volume, said concentration of gaseous ammonia being controlled by adjusting the amount of oxygen in said fluidizing gas stream;

(5) maintaining the concentration of gaseous carbon monoxide in said flue gas to less than about 500 ppm by volume by adjusting the amount of oxygen in said gas stream;

(6) feeding decarbonized fines of shale particles at a relatively cool temperature into the dense bed region of said first-stage combustion zone to aid in controlling temperature during staged combustion below a peak value between about 1400° and about 1670° F., said decarbonized fines of shale comprising no more than 50 percent by weight of the total shale particles introduced into said first-stage combustion zone; and (7) introducing inert diluent gas into said fluidizing gas stream to aid in controlling temperature during staged combustion below said peak value while maintaining said shale particles as a fluidized bed.

29. A process for combusting retorted shale particles as defined in claim 28, said process further comprising:

(8) admixing inert diluent gas into said fluidized bed during periods of reduced feed of retorted particles so as to maintain said concentration of gaseous ammonia as in step (4) hereinabove while maintaining said particles as a fluidized bed.

30. A process for combusting crushed retorted shale particles as defined in claim 29 wherein said fluidizing gas stream comprises between 60 and 100 percent of the air necessary for complete combustion of the combustible materials in said retorted particles, and said air stream comprises between about 10 and about 50 percent of the air necessary for complete combustion of the combustible materials in said retorted particles.

31. A process for combusting crushed retorted shale particles as defined in claim 15 wherein said fluidizing gas stream comprises between about 75 and about 85 percent of the oxygen necessary for complete combustion of the combustible materials in said retorted shale particles, said gas stream comprises between about 25 and about 35 percent of the oxygen necessary for complete combustion of the combustible materials in said retorted shale particles, the concentration of carbon monoxide in said flue gas is less than about 50 ppm by volume, and the size of said crushed particles ranges from about zero to about ½ inch means diameter.

32. A process for combusting crushed retorted shale particles as defined in claim 29 wherein said inert diluent gas is recycled flue gas.

33. A process for combusting crushed retorted shale particles as defined in claim 28 wherein said inert diluent gas is flue gas.

34. A process for combusting retorted shale particles as defined in claim 18 wherein the size of said crushed particles ranges from about zero to about ¼ inch mean diameter, said fluidizing gas stream comprises between about 75 and about 85 percent of the oxygen necessary for complete combustion of combustible materials in said retorted shale particles, said gas stream comprises between about 25 and about 35 percent of the oxygen necessary for complete combustion of the combustible materials in said retorted shale particles, and the concentration of carbon monoxide in said flue gas is less than about 50 ppm by volume.

* * * * *

UNITED STATES PATENT OFFICE

CERTIFICATE OF CORRECTION

Patent No. 4,543,894 Dated October 1, 1985

Inventor(s) Charles F. Griswold and Ben A. Christolini, Jr.

It is certified that error appears in the above-identified patent and that said Letters Patent are hereby corrected as shown below:

Column 7, line 59 (claim 1) after "containing" insert --combustible--.

Column 12, line 42 (claim 31) change "means" to read --mean--.

Signed and Sealed this

Third Day of December 1985

[SEAL]

*Attest:*

DONALD J. QUIGG

*Attesting Officer*

*Commissioner of Patents and Trademarks*